US005828939A

United States Patent [19]

Yoshiuchi et al.

[11] Patent Number: 5,828,939

[45] Date of Patent: Oct. 27, 1998

[54] SMOOTH TRANSFER SHEET ROLLER TRANSPORT

[75] Inventors: Katsuhiro Yoshiuchi; Masahiko Nakao; Keizo Yamamoto, all of Osaka, Japan

[73] Assignee: Mita Industrial Co., Ltd., Osaka, Japan

[21] Appl. No.: 803,642

[22] Filed: Feb. 21, 1997

Related U.S. Application Data

[62] Division of Ser. No. 569,980, Dec. 8, 1995, Pat. No. 5,651,539.

[30] Foreign Application Priority Data

| | | | |
|---|---|---|---|
| Jan. 10, 1995 | [JP] | Japan | 7-2290 |
| Jan. 10, 1995 | [JP] | Japan | 7-2291 |
| Jan. 10, 1995 | [JP] | Japan | 7-2292 |

[51] Int. Cl.[6] ..... G03G 15/00

[52] U.S. Cl. ..... 399/388; 358/474; 399/400

[58] Field of Search ..... 399/388, 400, 399/397, 396, 67, 68; 358/474, 486, 496, 497

[56] References Cited

U.S. PATENT DOCUMENTS

| | | | |
|---|---|---|---|
| 3,863,913 | 2/1975 | Hirafuji | 271/270 X |
| 4,708,456 | 11/1987 | Shibata et al. | 355/317 X |
| 5,362,041 | 11/1994 | Ryuzaki et al. | 271/242 X |
| 5,417,413 | 5/1995 | Huffman et al. | 271/270 X |
| 5,428,431 | 6/1995 | Abe et al. | 355/317 X |
| 5,482,265 | 1/1996 | Nakazato et al. | 271/270 X |
| 5,561,512 | 10/1996 | Fukano et al. . | |

FOREIGN PATENT DOCUMENTS

| | | |
|---|---|---|
| 660198 | 12/1994 | European Pat. Off. . |
| 61-32869 | 2/1986 | Japan . |
| 130944 | 6/1987 | Japan . |
| 39143 | 2/1993 | Japan . |
| 1495 | 1/1994 | Japan . |

*Primary Examiner*—Arthur T. Grimley
*Assistant Examiner*—Quana Grainger
*Attorney, Agent, or Firm*—Beveridge, DeGrandi, Weilacher & Young, L.L.P.

[57] ABSTRACT

An image forming apparatus that includes an image reading section, a transportation path, a photoreceptor, transferring area, a fixing area, and a feeding speed controller. The feeding speed controller selects the speed at which an original document passes through the image reading section between two speeds. A first speed is used when the transfer sheet is normal sized and for a period of time prior to a large sized sheet entering the fixing area. Once a large sized sheet enters the fixing area, the feeding speed controller changes the speed of the original document from the first speed to the second speed to provide proper scaling of the reproduced image on the transferred sheet. The second speed may be adjusted depending on the type of transfer sheet being used to take into account the amount of stretching of the material used to make the transfer sheet.

4 Claims, 6 Drawing Sheets

SMOOTH TRANSFER SHEET ROLLER TRANSPORT

This is a divisional of application Ser. No. 08/569,980 filed on Dec. 8, 1995 U.S. Pat. No. 5,651,539 which is incorporated herein in its entirety.

BACKGROUND OF THE INVENTION

1. Field of the Invention

The present invention relates to an image forming apparatus capable of forming an image on a large-size transfer sheet.

2. Description of the Prior Art

Electrophotographic copying machines are widely used which are adapted to scan a document original under light irradiation, form an electrostatic latent image on a photoreceptor by light rays reflected on the document original, develop the electrostatic latent image into a toner image, and thermally fix the toner image on a transfer sheet. Some of these copying machines are capable of copying a large-size document original such as of JIS A0 size.

The copying machines for copying a large-size document original have a reading mechanism capable of reading a large-size document original and a transporting mechanism capable of transporting a transfer sheet of a large size corresponding to the size of the document original.

When such a large-size transfer sheet is transported, the transfer sheet is liable to be biased, resulting in transportation failure (so-called jam) of the transfer sheet.

Further, when the transfer sheet is transported from one transportation roller to the next transportation roller, there is a tendency to form a distorted copy image.

The transfer sheet traveling speed relative to the circumferential speed of the photoreceptor should be constant when a toner image on the photoreceptor is transferred onto the transfer sheet. If the transfer sheet traveling speed relative to the circumferential speed of the photoreceptor is changed, the scale of an image to be copied is changed in a transfer sheet transportation direction. Where a large-size transfer sheet is transported, it is difficult to keep the transfer sheet traveling speed relative to the circumferential speed of the photoreceptor constant because of the structure of the copying machine. This is because a transportation speed at which the transfer sheet is taken into a fixing unit from the photoreceptor for fixing the toner image on the transfer sheet is generally set higher than a transportation speed at which the transfer sheet is fed into the photoreceptor. Where a larger-size transfer sheet is used, the rearward portion of the transfer sheet does not reach the photoreceptor, when the leading edge of the transfer sheet enters the fixing unit. Therefore, the scale of an image to be copied on the transfer sheet is changed during the transportation of the transfer sheet.

For the foregoing reason, there is a need to prevent the scale of an image to be copied on the transfer sheet from being changed.

Additionally, there is a similar problem to be solved in image forming apparatuses other than copying machines, for example, printing machines for printing an image on a larger size sheet.

In view of the foregoing problem, it is one object of the present invention to provide an image forming apparatus comprising a transportation mechanism capable of properly transporting a large-size transfer sheet.

It is another object of the present invention to provide an image forming apparatus which is so improved as to prevent a transfer sheet from being biasedly transported.

It is still another object of the present invention to provide an image forming apparatus which is so improved as not to distort an image to be transferred onto a transfer sheet: nor change the scale of the image even if the transfer sheet transportation speed relative to the circumferential speed of the photoreceptor is changed during the transportation of the transfer sheet.

SUMMARY OF THE INVENTION

In accordance with the first feature of the present invention, there is provided an image forming apparatus comprising two transportation rollers, i.e., a first roller and a second roller, provided on a transportation path for guiding a transfer sheet to an image forming section. The first roller is adapted to stop the leading edge of the transfer sheet transported to the transportation path so as to align the leading edge of the transfer sheet with a line perpendicular to a transportation direction. The second roller is adapted to feed the transfer sheet to the image forming section at a predetermined transportation speed. The first roller is rotated at a circumferential speed lower by a predetermined degree than that of the second roller, thereby constantly applying a predetermined tensile force to the transfer sheet retained between the first roller and the second roller to prevent the transfer sheet from being biased during the transportation.

In accordance with the aforesaid feature, the predetermined tensile force is applied to the transfer sheet transported from the first roller to the second roller. This prevents the transfer sheet from being biased with respect to the transportation direction, i.e., from being biasedly transported.

In accordance with another feature of the present invention, there is provided an image forming apparatus characterized in that either a sheet obtained by cutting into a predetermined length an elongated roll sheet paid out of a roll body around which the elongated roll sheet is wound or a cut-sheet preliminarily cut into a predetermined size is used as the transfer sheet.

In accordance with another feature of the present invention, there is provided an image forming apparatus wherein the first roller driving control means operates in a manner as cited in the first feature where the transfer sheet is the cut-sheet.

The aforesaid feature eliminates a tendency of the cut-sheet as the transfer sheet to be biased.

In accordance with another feature of the present invention, there is provided an image forming apparatus further comprising: sheet edge detection means provided upstream of the first roller along the transfer sheet transportation direction on the transportation path; wherein the first roller driving control means rotates the first roller at a circumferential speed lower by a predetermined degree than that of the second roller as cited in claim 1 in a state where the leading edge of the transfer sheet is not detected by the sheet edge detection means and, in response to the leading edge of the transfer sheet being detected by the sheet edge detection means, increases the circumferential speed of the first roller from the lower speed into a speed higher by a predetermined degree than that of the second roller to smoothly relieve a tensile force applied to the transfer sheet retained between the first roller and the second roller.

In accordance with the aforesaid feature, when the tail edge of the transfer sheet departs from the first roller, the circumferential speed of the first roller is increased, so that the tensile force applied to the transfer sheet is smoothly relieved. This can eliminate a sudden fluctuation in the tensile force which may otherwise occur when the tail edge of the transfer sheet departs from the first roller. Therefore, the transfer sheet is transported to the image forming section at a predetermined speed by the second roller without suffering from a sudden fluctuation in the load to the second roller. Thus, the distortion of an image to be transferred onto the transfer sheet can be prevented.

In accordance with another feature of the present invention, there is provided an image forming apparatus, wherein the first roller is a resist roller for adjusting the timing of transporting the transfer sheet to the image forming section, and the second roller is a transportation roller for feeding the transfer sheet to the image forming section at a constant speed.

In accordance with another feature of the present invention, there is provided an image forming apparatus wherein the transfer sheet to be transported is a sheet having a length longer than the distance between the first roller and the second roller along the transportation path, and an image is transferred onto the sheet in the image forming section.

In accordance with another feature of the present invention, there is provided an image forming apparatus wherein the image forming section electro-photographically forms an image and transfers the formed image onto a given transfer sheet.

In accordance with another feature of the present invention, there is provided an image forming apparatus further comprising: an image reading section for reading an image of a document original along a reading line; document-original feeding means for changing a relative positional relation between the image reading section and the document original in a direction perpendicular to the reading line; fixing means disposed downstream of the image forming section along the transfer sheet transportation direction on the transportation path for taking in the transfer sheet transported from the image forming section and having an image transferred thereon at a transportation speed higher than that in the image forming section, then fixing the transferred image on the transfer sheet, and discharging the transfer sheet; and the image forming apparatus is characterized in that document-original feeding speed control means for controlling the document-original feeding means so as to change the relative positional relation between the image reading section and the document original at a relatively low first speed until the leading edge of the transfer sheet transported through the transportation path reaches the fixing means and, in response to the leading edge of the transfer sheet reaching the fixing means, controlling the document-original feeding means so as to change the relative positional relation at a relatively high second speed.

In accordance with the aforesaid feature, the scale difference between images formed on forward and rearward portions of the transfer sheet is not produced and, therefore, an excellent image can be formed. In particular, an excellent image formation can be realized where the transfer sheet has a length longer than the distance between the image transportation position and the fixing position.

In accordance with another feature of the present invention, there is provided an image forming apparatus wherein the first speed controlled by the document-original feeding speed control means is equivalent to the speed at which the image forming section feeds out the transfer sheet, and the second speed varies depending on the type of transfer sheet.

DESCRIPTION OF THE PREFERRED EMBODIMENTS

An embodiment of the present invention will hereinafter be described With reference to the attached drawings.

Figure 1:
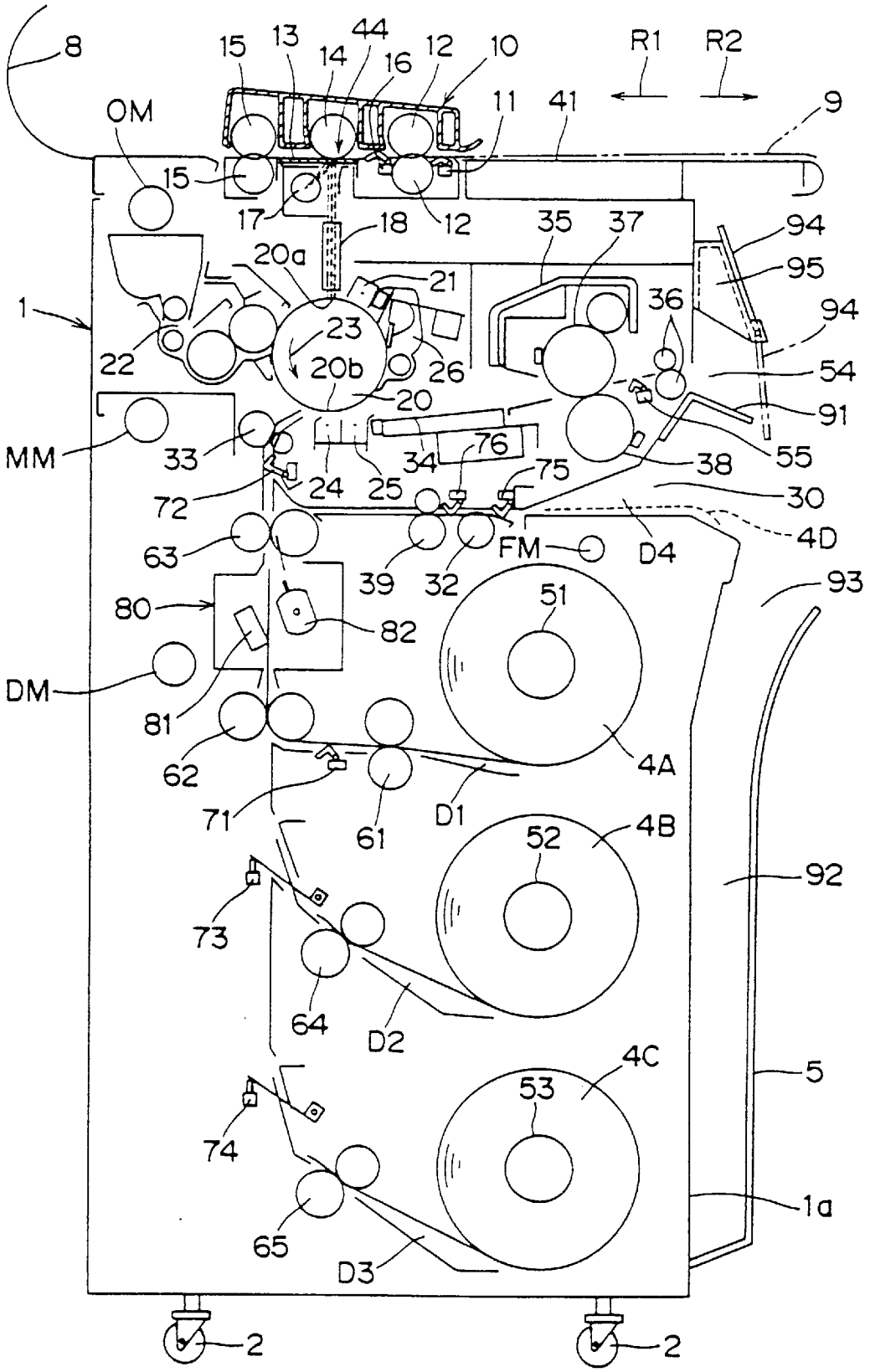
Fig. 1 a schematic sectional view illustrating the internal construction of a copying machine in accordance with one embodiment of the present invention.
Figure 2:
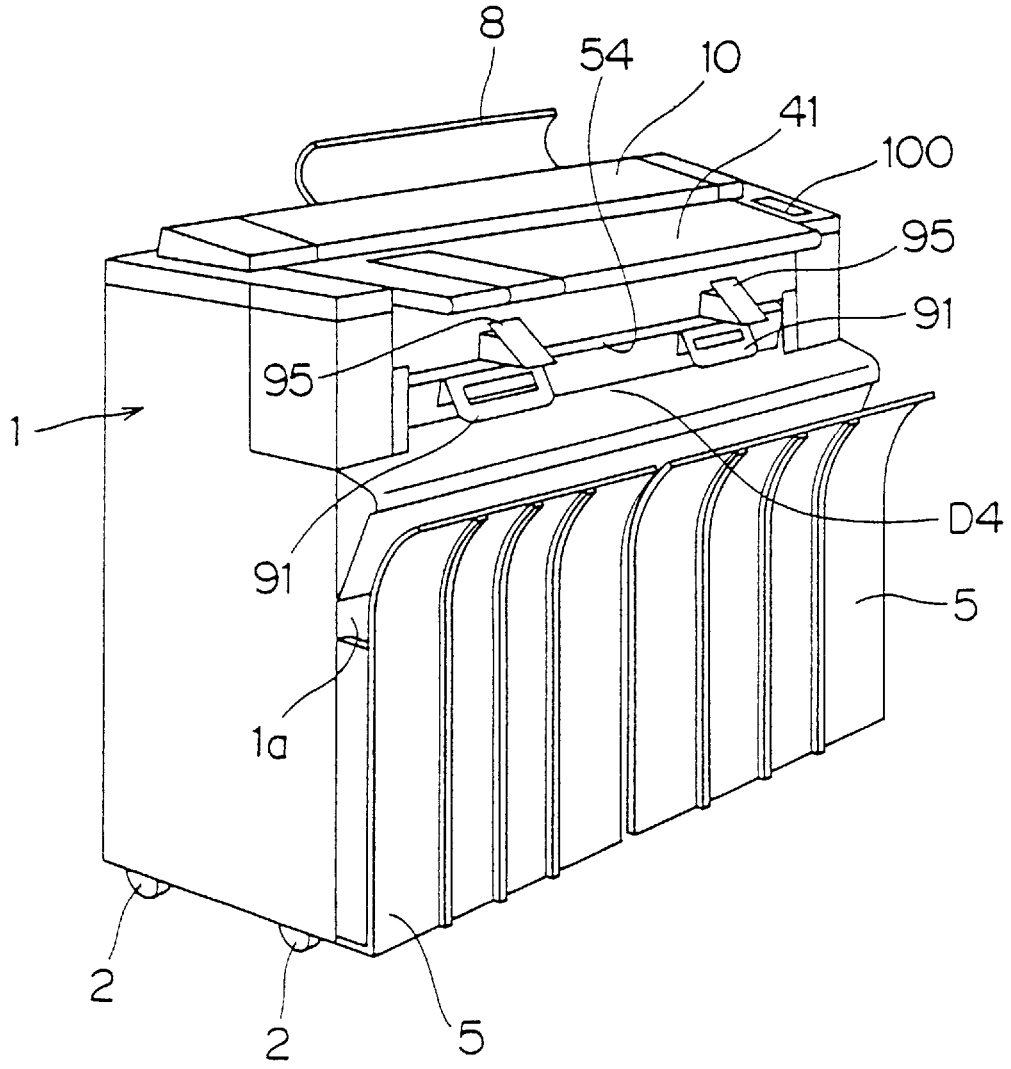
Fig. 2 is a perspective view illustrating the external construction of the copying machine in accordance with one embodiment of the present invention.
Figure 3:
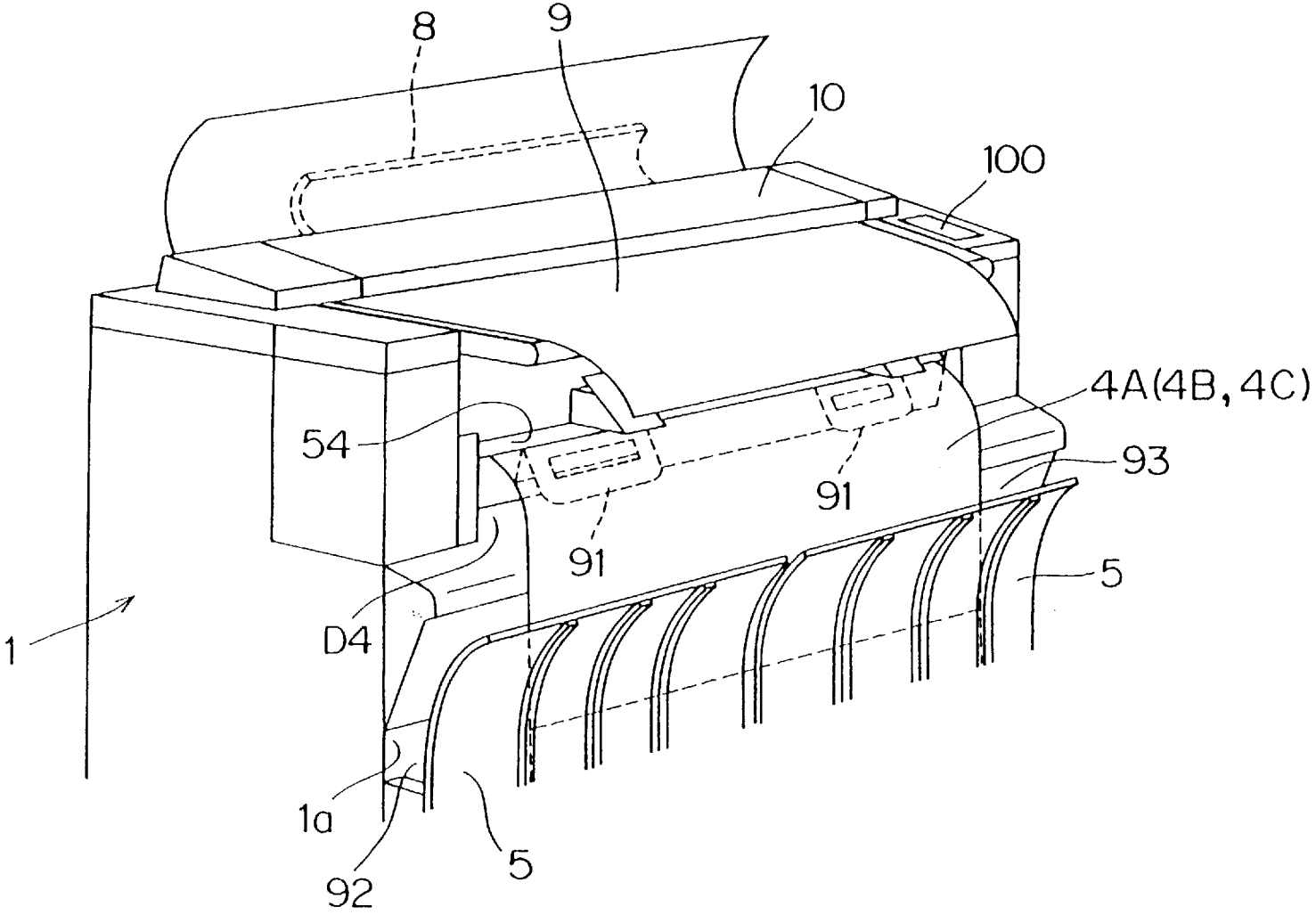
Fig. 3 is a perspective view illustrating the appearance of the copying machine which is performing a copying operation in accordance with one embodiment of the present invention.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of A0 size. In the copying machine, the document original is scanned under light irradiation by a stationary optical system while being transported, and an image is formed on the basis of the optical scanning.

Referring to FIG. 1, a machine body 1 has caster wheels 2 on the under side thereof for free movement. Referring to FIGS. 1 to 3, a document-original transportation section 10 for transporting a document original 9 along a document-original transportation path 41 formed on the top face of the machine body 1 is provided on the machine body 1. A discharge port 54 for discharging a sheet having a toner image transferred thereon opens in a front face la of the machine body 1. The sheet discharged from the discharge port 54 is guided by a guide member 91, dropped through a guide opening 93 with the leading edge thereof oriented downward, and accommodated in a pocket 92 defined by a front cover 5 provided along the front face la of the machine body 1, as shown in FIG. 3. On an edge portion of the top face of the machine body 1 is provided with an operation section 100 having switches, keys and the like for making various settings related to a copying operation.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face la of the machine body 1.

The roll sheet 4A in the upper position is transported along a first transportation path Dl to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order.

The roll sheet 4B in the middle position is transported along a second transportation path D2 to the photoreceptor drum 20 through the feed reel 52, sheet feeding rollers 64, a third-leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The path downstream of the transportation rollers 62 is common to the first transportation path Dl.

The roll sheet 4C in the lower position is transported along a third transportation path D3 to the photoreceptor drum 20 through the feed reel 53, sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path Dl.

The bypass transportation path D4 is a path which leads the cut-sheet 4D introduced from the manually sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path Dl.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11,, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4" when the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharge 24 for image transfer is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger 24 for image transfer, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger 24 for image transfer with being brought into contact with the surface of the photoreceptor drum 20. Then, the toner image formed on the surface of the photoreceptor drum 20 is transferred onto the sheet 4 by way of corona discharge by the corona discharger 24 for image transfer. The sheet 4 having the toner image transferred thereon is removed from the surface of the photoreceptor drum 20 by way of corona discharge by a corona discharger 25 for sheet removal, and then led to a fixing unit 35 through the transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide member 91, and accommodated in the pocket 92, as described above. After the toner image is transferred, the toner remaining on the surface of the photoreceptor drum 20 is removed by a cleaning unit 26 for the next electrostatic latent image formation.

Similarly, the cut-sheet 4D led to the photoreceptor drum 20 from the bypass sheet feeding path D4 is subjected to the toner image transfer and the toner fixation, and then discharged into the pocket 92.

Above the guide member 91 is disposed an auxiliary guide plate 94. The auxiliary guide plate 94 is pivotally supported by a stay 95 attached to the front face la of the machine body 1. The auxiliary guide plate 94 assumes either an attitude (indicated by a dashed line in FIG. 1) for guiding the discharged sheet 4 hanging down forwardly of the guide member 91 into the pocket 92 cooperatively with the guide member 91 or an attitude (indicated by a solid line in FIG. 1) for sheet accommodation in which the auxiliary guide plate 94 is supported by the stay 95. The attitude of the auxiliary guide plate 94 can be shifted by the pivotal movement thereof.

Image forming means is constituted by such members as the photoreceptor drum 20, the developing unit 22 and the corona discharger 24 for image transfer. In this embodiment, the copying machine further includes a main motor MM for driving the image forming means, a sheet feeding motor DM for driving the transportation rollers for feeding the sheet 4A, 4B, 4C and 4D, a fixation motor FM for driving the heat roller 37 and press roller 38 of the fixing unit 35, and a document-original feeding motor OM for driving the document original transportation section 10.

Figure 4:
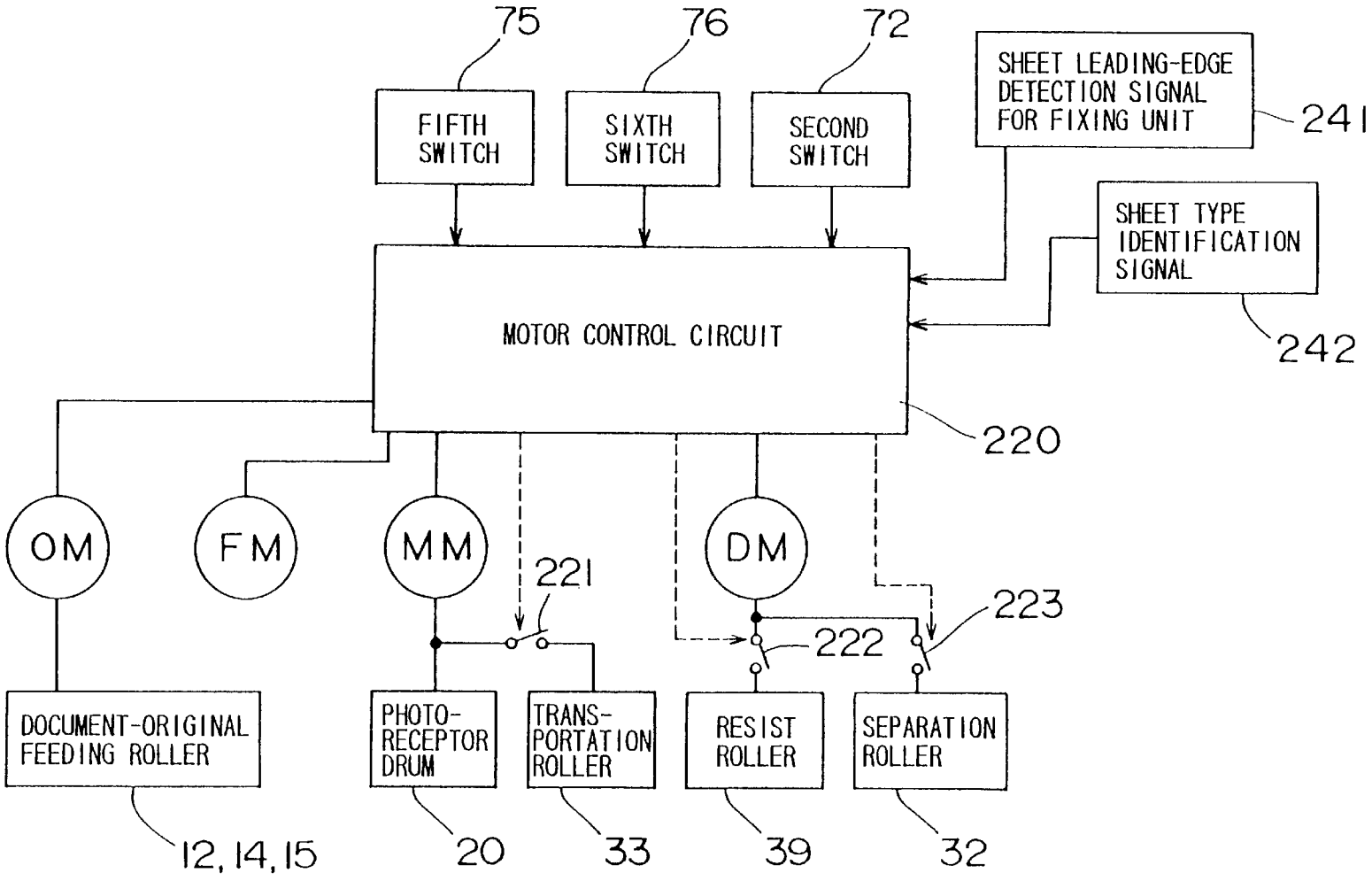
Fig. 4 is a block diagram illustrating the construction of a control circuit for a transportation path of the copying machine in accordance with one embodiment of the present invention.

FIG. 4 is a block diagram illustrating one exemplary construction of a control circuit of the copying machine in accordance with this embodiment. The control circuit has a motor control circuit 220. The motor control circuit 220 may be a dedicated control circuit or may be incorporated in a CPU or the like which controls the operation of the copying machine.

To the motor control circuit 220 are applied signals from the fifth leading-edge detection switch 75, the sixth leading-edge detection switch 76 and the second leading-edge detection switch 72. A sheet leading-edge detection signal 241 for the fixing unit and a sheet type identification signal 242 are also applied to the motor control circuit 220. Base on these signals, the motor control circuit 220 controls the main motor MM, the sheet feeding motor DM, the fixation motor FM and the document-original feeding motor OM. The rotational speeds of the main motor MM and the fixation motor FM are controlled to be always constant. Further, the motor control circuit 22C controls the rotation and stoppage of the transportation rollers 33, the resist rollers 39 and the separation roller 32 by controlling the clutches 221, 222 and 223.

Referring to FIGS. 1 and 4, one of the features of the copying machine is an improvement in which the cut-sheet transported through the bypass transportation path D4 is prevented from being biased with respect to the transportation direction of the cut-sheet or from being biasedly transported. The prevention of biasing of the cut-sheet is achieved, as will be later described, by setting the rotational circumferential speed of the resist rollers 39 (the first roller) slightly lower than that of the transportation rollers 33 (the second roller).

Another feature of this embodiment is that the offset of a toner image to be transferred onto a cut-sheet is prevented which is caused by vibration of the cut-sheet due to fluctuation in the load to the transportation rollers 33. The load fluctuation is caused by a sudden removal of the tensile force which has been applied to the cut-sheet, when the tail edge of the cut-sheet transported through the bypass transportation path D4 departs from the resist rollers 39. The prevention of the image offset on the cut-sheet is also achieved by controlling the circumferential speed of the resist rollers 39.

Figure 5:
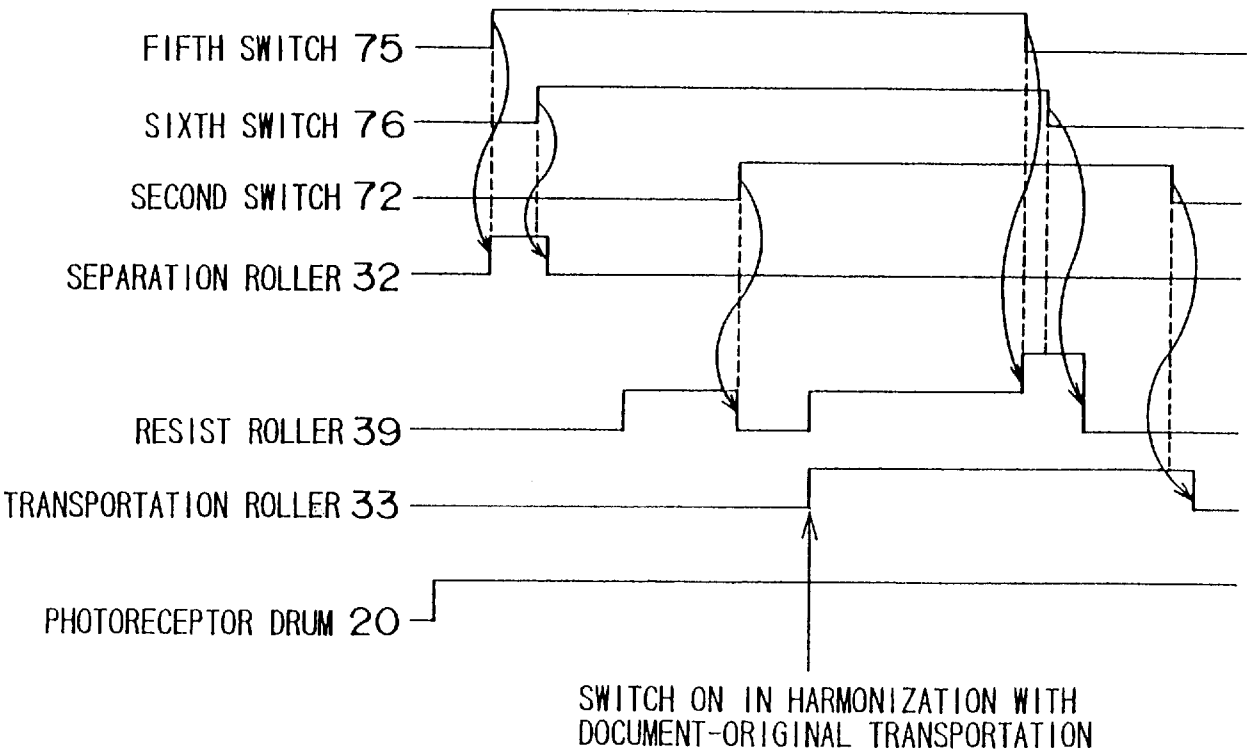
Fig. 5 is a timing chart illustrating one example of operational timings for the transportation control shown in FIG. 4.

More specific explanation will be given to the rotation control of the photoreceptor drum 20, the transportation rollers 33, the resist rollers 39 and the separation roller 32 with reference to a timing chart in FIG. 5.

The main motor MM is driven, and the photoreceptor drum 20 starts rotating. When a cut-sheet is inserted from the manually sheet feeding section 30 in this state, the fifth leading-edge detection switch 75 is switched on by the leading edge of the cut-sheet.

In response to an ON signal of the fifth leading-edge detection switch 75, the motor control circuit 220 rotates the sheet feeding motor DM, and switches on the clutch 223 to rotate the separation roller 32. Thus, the cut-sheet inserted from the manually sheet feeding section 30 is taken in and transported to the resist rollers 39. Where a plurality of cut-sheets are inserted from the manually sheet feeding section 30, the cut-sheets are taken in on the one-by-one basis by means of the separation roller 32.

When the cut-sheet is taken in by the separation roller 32, the leading edge of the cut-sheet switches on the sixth leading-edge detection switch 76. An ON signal of the sixth leading-edge detection switch 76 is applied to the motor control circuit 220. The motor control circuit 220 switches off the clutch 223 a predetermined time period after receiving the ON signal, and stops the rotation of the separation roller 32. This ensures that the cut-sheet is stopped with the leading edge thereof abutting against the resist rollers 39. More specifically, if the cut-sheet inserted from the manually sheet feeding section 30 is slightly biased with respect to the bypass transportation path D4, only a part of the leading edge of the cut-sheet abuts against the resist rollers 39. When the cut-sheet is further forced forward by the separation roller 32 in this state, the biased attitude of the cut-sheet is corrected so that the cut-sheet is aligned with the bypass transportation path D4. Thus, the entire leading edge of the cut-sheet abuts against the resist rollers 39. That is, the leading edge of the cut-sheet is aligned with a line perpendicular to the transportation direction.

Thereafter, the clutch 222 is switched on at a predetermined time point, and the resist rollers 39 are rotated by the sheet feeding motor DM. The cut-sheet is transported along the bypass transportation path D4 by the rotation of the resist rollers 39, and the leading edge thereof reaches the transportation rollers 33. Just prior to the transportation rollers 33 is provided the second leading-edge detection switch 72. Therefore, when the leading edge of the cut-sheet is about to reach the transportation rollers 33, the second leading-edge detection switch 72 is switched on.

The motor control circuit 220 switches off the clutch 222 and stops the resist rollers 39 in response to an ON signal of the second leading-edge detection switch 72 applied thereto.

The clutches 221 and 222 are switched on at a predetermined time point in coordination with the transportation of the document original by the document transportation section 10. The transportation rollers 33 and the resist rollers 39 are rotated, thereby transporting the cut-sheet.

In this case, the rotational circumferential speed of the transportation rollers 33 is set to a level different from that of the resist rollers 39. More specifically, the rotational circumferential speed of the resist rollers 39 is set lower by about 1% to 2% than that of the transportation rollers 33. Thereby, the cut-sheet is transported by the transportation rollers 33 at a higher speed and transported by the resist rollers 39 at a lower speed. Accordingly, a predetermined tensile force is constantly applied to the cut-sheet traveling from the resist rollers 39 to the transportation rollers 33. The application of the predetermined tensile force to the cut-sheet transported along the transportation path prevents the cut-sheet from being biased with respect to the transportation path or from being biasedly transported.

As described above, the copying machine in accordance with this embodiment is capable of copying a large-size document original such as of A0 size. To copy a document original of A0 size, a cut-sheet to be inserted from the manually sheet feeding section 30 has to be of A0 size. When the leading edge of such a large-size cut-sheet transported through the transportation rollers 33 reaches the photoreceptor drum 20, the rearward portion thereof hangs down from the entrance of the manually sheet feeding section 30. As the cut-sheet is further transported, the tail edge of the cut-sheet passes through the fifth leading-edge detection switch 75. When the tail edge of the cut-sheet passes through the fifth leading-edge detection switch 75, the fifth leading-edge detection switch 75 is switched off.

In response to an OFF signal of the fifth leading-edge detection switch 75, the motor control circuit 220 increases the rotational speed of the sheet feeding motor DM. The rotational circumferential speed of the resist rollers 39 is increased by the increase in the rotational speed of the sheet feeding motor DM. More specifically, the rotational circumferential speed of the resist rollers 39 is increased, for example, by about 5% to 7%. Since the increase in the rotational circumferential speed of the resist rollers 39 is achieved by increasing the rotational speed of the sheet feeding motor DM, not by shifting a clutch, the circumferential speed can be smoothly increased. Therefore, the tensile force applied to the cut-sheet traveling from the resist rollers 39 to the transportation rollers 33 is smoothly relieved without giving a shock to the cut-sheet transported by the transportation rollers 33 and the resist rollers 39.

Thereafter, the tail edge of the cut-sheet passes through the sixth leading-edge detection switch 76, which is thereby switched off, and then departs from the resist rollers 39.

When the tail edge of the cut-sheet departs from the resist rollers 39, the tensile force applied to the cut-sheet transported from the resist rollers 39 to the transportation rollers 33 is relieved as described above. Therefore, the transportation rollers 33 suffer from no load fluctuation and apply no vibration to the cut-sheet at the moment the tail edge of the cut-sheet departs from the resist rollers 39.

The clutch 222 is switched off a predetermined time period (e.g., about one second) after the sixth leading-edge detection switch 76 is switched off, thereby stopping the resist rollers 39.

Thereafter, the tail edge of the cut-sheet passes through the second leading-edge detection switch 72, thereby switching off the second leading-edge detection switch 72. Then, the tail edge of the cut-sheet is transported from the transportation rollers 33 to the photoreceptor drum 20. The clutch 221 is switched off a predetermined time period after the tail edge of the cut-sheet departs from the transportation rollers, i.e., after the second detection switch 72 is switched off, thereby stopping the transportation rollers 33.

In this embodiment, the resist rollers 39 provided on the bypass transportation path D4 allow the leading-edge of the cut-sheet inserted into the bypass transportation path D4 to be aligned with a line perpendicular to the transportation direction, as described above. In such a state, the transportation of the cut-sheet is started, and a predetermined tensile force is constantly applied to the cut-sheet transported from the resist rollers 39 to the transportation rollers 33. This prevents the cut-sheet transported along the transportation path from being biased with respect to the transportation path.

However, at the moment the tail edge of the cut-sheet transported from the resist rollers 39 to the transportation rollers 33 with the tensile force constantly applied thereto departs from the resist rollers 39, the tensile force is suddenly removed from the cut-sheet. This may cause load fluctuation to the transportation rollers 33 and give vibration to the cut-sheet.

In this embodiment, when the tail edge of the transported cut-sheet is brought into the vicinity of the resist rollers 39, the rotational circumferential speed of the resist rollers 39 is increased to smoothly relieve the tensile force applied to the cut-sheet transported from the resist rollers 39 to the transportation rollers 33.

Thus, the biased transportation and image offset can be prevented which tend to occur when a large-size cut-sheet is transported along the bypass transportation path D4.

Though the copying machine in accordance with this embodiment is adapted to use a roll sheet as the transfer sheet on a regular basis and, when using a cut-sheet as the transfer sheet, manually feed thereto the cut-sheet from the manually sheet feeding section 30, the construction of the present invention is applicable to a copying machine which is adapted to use a cut-sheet as the transfer sheet on a regular basis and automatically feed thereto the cut-sheet.

In the aforesaid embodiment, the explanation has been given to the method for controlling the cut-sheet transportation which is employed when a cut-sheet is used as the transfer sheet. This method can be applied to the sheet transportation control where a roll sheet is used as a transfer sheet.

To be more specifically described with reference to FIG. 1, the transportation rollers 63 and 33 are used where the roll sheet 4A, 4B or 4C is transported to the photoreceptor dram 20. The method for controlling the rotation of the resist rollers 39 previously described with reference to FIG. 5 is applied to the rotation control of the transportation rollers 63. Thus, a tensile force can be applied to the roll sheet transported from the transportation rollers 63 to the transportation rollers 33, thereby preventing the roll sheet from being biasedly transported. When the tail edge of the roll sheet departs from the transportation rollers 63, the rotational speed of the transportation rollers 63 is increased, thereby preventing the roll sheet from being subjected to vibration.

With the aforesaid arrangement, the transfer sheet can be transported to the image forming section without being biased with respect to the transportation direction. Therefore, the copying machine rarely causes jam of a transfer sheet.

In particular, where a large-size cut-sheet is used as the transfer sheet, the occurrence of jam of the cut-sheet can be significantly reduced.

As described above, the proper transportation of a transfer sheet can be ensured by giving consideration to the method for controlling the transportation of the transfer sheet.

In the present invention, distortion of an image to be transferred onto a transfer sheet can be prevented not only by controlling the transportation of a transfer sheet but also by changing the transportation speed of a document original.

The method for controlling the transportation speed of a document original will hereinafter be described more specifically. In case of an electrophotographic copying machine, the sheet transportation speed in a fixing unit is generally set a little higher than the circumferential speed of a photoreceptor. This is because a consideration is given to prevent the slacking of the transfer sheet which may occur when the transfer sheet having a toner image transferred thereto from the photoreceptor drum is transported to the fixing unit.

Where a fairly long-size transfer sheet is used, the transfer sheet traveling speed relative to the circumferential speed of the photoreceptor drum varies. More specifically, where the leading edge of a transfer sheet has not yet reached the fixing unit and the toner image is transferred onto a forward portion of the transfer sheet, the transfer sheet traveling speed relative to the circumferential speed of the. photoreceptor drum is low.

On the other hand, where the leading edge of the transfer sheet has reached the fixing unit and the toner image is transferred onto a rearward portion of the transfer sheet from the photoreceptor drum, the rearward portion of the transfer sheet travels at a speed higher than the circumferential speed of the photoreceptor drum. That is, the forward portion of the long-size transfer sheet is transported at a relatively low speed with respect to the circumferential speed of the photoreceptor drum, while the rearward portion of the long-size transfer sheet is transported at a relatively high speed. Therefore, the scale of an image slightly varies along the transportation direction, i.e., the forward portion and rearward portion of the transfer sheet have slightly different image scales.

In this embodiment, the transportation speed of the document original is changed in accordance with the change in the transportation speed of the transfer sheet for correction of the image scale.

Where the transfer sheet traveling speed relative to the circumferential speed of the photoreceptor drum is relatively low, i.e., where the image is transferred onto the forward portion of the transfer sheet, the document original is transported at a relatively low regular speed (generally at the same speed as the circumferential speed of the photoreceptor drum). On the other hand, when the leading edge of the transfer sheet reaches the fixing unit which starts transporting the transfer sheet at a relatively high speed, the document original is transported at a relatively high speed in harmonization therewith. As a result, the document original image to be formed on the photoreceptor drum is slightly shrunk as the transportation speed of the document original becomes relatively high, and the shrunk image is slightly expanded to be transferred on the transfer sheet as the transportation speed of the transfer sheet becomes relatively high. Thus, the document original image is transferred onto the transfer sheet without changing the scale thereof.

More specifically, the rotational speed of the document-original feeding motor OM is changed in accordance with the change in the transportation speed of the transfer sheet under the control by the motor control circuit 220. When the speed of the document-original feeding motor OM is changed, the rotational circumferential speeds of the first transportation rollers 12, the second transportation roller 14 and the third transportation rollers 15 in the document-original transportation section 10 (shown in FIG. 1) driven by the motor OM are changed. Thus, the transportation speed of the document original is changed.

The motor control circuit 220 changes the rotational speed of the document-original feeding motor OM in response to a transfer-sheet leading-edge detection signal 241 for the fixing unit applied thereto. The transfer-sheet leading-edge detection signal 241 for the fixing unit indicates a time point at which the heat roller 37 and press roller 38 start transporting the transfer sheet at a transportation speed higher than the former transportation speed when the leading edge of the transfer sheet transported along the transportation path 34 (see FIG. 1) reaches the fixing unit 35. For example, the transfer-sheet leading-edge detection signal 241 for the fixing unit is output a predetermined time period after the transportation rollers 33 start transporting the transfer sheet toward the photoreceptor drum 20. That is, the transfer sheet is once stopped at the transportation rollers 33, and then the transportation of the transfer sheet by the transportation rollers 33 is started in synchronization with the start of the image formation at the photoreceptor drum 20. The transportation rollers 33 are driven by the main motor MM, which constantly transports the transfer sheet at a constant speed. Accordingly, the leading edge of the transfer sheet transported through the transportation path 34 reaches the fixing unit 35 the predetermined time period after the transportation rollers 33 start transporting the transfer sheet. Therefore, the transfer-sheet leading-edge detection signal 241 for the fixing unit is output the predetermined time period after the start of the driving of the transportation rollers 33.

In another arrangement of the present invention, a leading-edge detection switch is disposed prior to the fixing unit 35 or in a given position on the transportation path 34., and the transfer-sheet leading-edge detection signal 241 for the fixing unit is output a predetermined time period after an ON signal is output when the leading-edge detection switch is switched on by the passage of the leading edge of the transfer sheet transported along the transportation path 34.

Thus, the transfer-sheet leading-edge detection signal 241 for the fixing unit indicates a time point at which the fixing unit 35 starts transporting the transfer sheet at a transportation speed higher than the former transportation speed when the leading edge of the transfer sheet transported along the transportation path 34 reaches the fixing unit 35.

Figure 6:
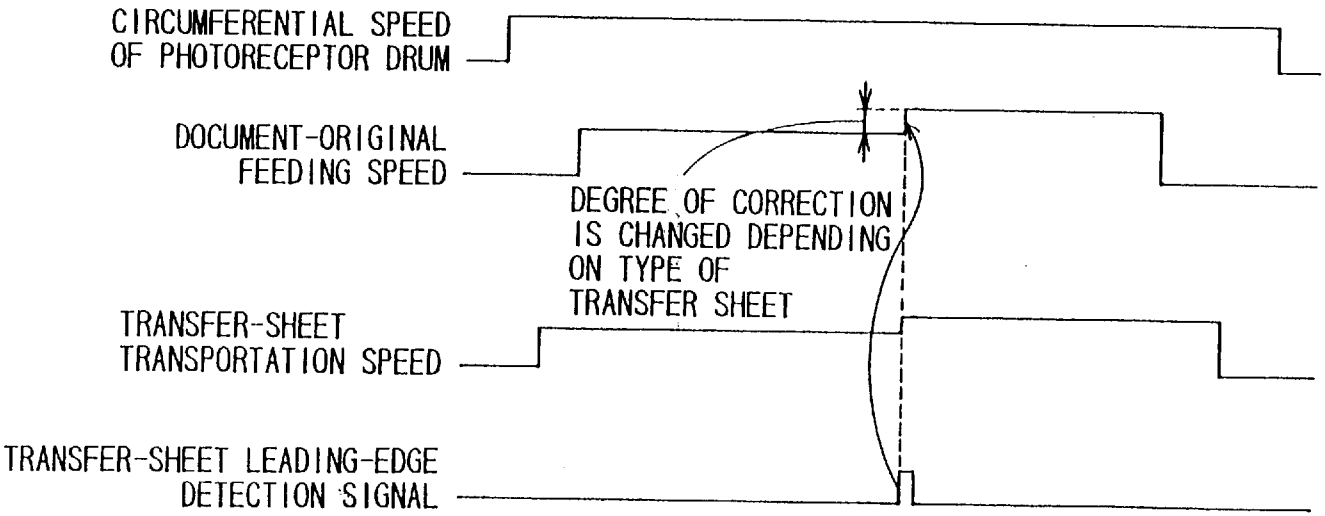
Fig. 6 is a timing chart illustrating another example of operational timings for the transportation control shown in FIG. 4.

As shown in FIG. 6, the motor control circuit 220 increases the rotational speed of the document-original feeding motor OM in response to the transfer-sheet leading-edge detection signal 241, thereby increasing the transportation speed of the document original. Accordingly, the document original image to be formed on the photoreceptor drum is slightly shrunk in the rotational direction of the photoreceptor drum by the increase in the document-original transportation speed. However, since the transfer sheet is transported to the photoreceptor drum at a higher speed, the shrunk image is slightly expanded in the transportation direction of the transfer sheet to be transferred on the transfer sheet. Thus, the scale of the document original image can be kept unchanged despite the change in the transportation speed of the transfer sheet.

Referring back to FIG. 4, the motor control circuit 220 also receives a transfer-sheet type identification signal 242. The copying machine uses as the transfer sheet the roll sheet 4A, 4B or 4C or the cut-sheet transported through the bypass transportation path D4. The transfer-sheet type identification signal 242 indicates the type of the transfer sheet to be used.

The motor control circuit 220 corrects a change in the speed of the document-original feeding motor OM in accordance with the type of the transfer sheet to be used. This is because different types of transfer sheets have different stretchabilities. More specifically, a film sheet, normal paper and tracing paper have greater stretchabilities in this order. The difference in the stretchability between transfer sheets influences the change in the scale of an image which is to occur when the transportation speed relative to the circumferential speed of the photoreceptor drum 20 is changed. In this embodiment, the rate of change in the rotational speed of the document-original feeding motor OM is, therefore, suitably corrected depending on the type of transfer sheet to change the rate of change in the document-original feeding speed. As a result, the scale of an image to be formed can be corrected to be equivalent to that of the document original image, regardless of the type of transfer sheet to be used.

Where a copy is to be made from a large-size document original on a transfer sheet of a large size corresponding to the size of the document original, the copying machine with the construction of this embodiment prevents the change in the scale of an image to be copied along the transportation direction, thereby providing an excellent copy image.

In accordance with the aforesaid embodiment, an improved copying machine capable of forming an excellent copy image is provided, which does not produce a scale difference between images formed on forward and rearward portions of a transfer sheet where the transfer sheet has a length longer than the distance between an image transfer position and an image fixing position.

The copying machine is particularly suitable for copying an image on a large-size transfer sheet such as of A0 size.

Though a copying machine is taken as an example of the image forming apparatus in the foregoing description, the present invention is applicable to any other image forming apparatuses such as printing machine, which are adapted to form an image on a particularly large-size transfer sheet.

What is claimed is:

1. An image forming apparatus of electrophotographic type for transferring an image on a transfer sheet having a length longer than a distance between an image transferring position and a fixing position, the image forming apparatus comprising:

an image reading section for reading an image of a document original along a reading line;

document original feeding means for changing a relative positional relation between the image reading section and the document original in a direction perpendicular to the reading line;

a transportation path for guiding the transfer sheet;

a drum-shaped photoreceptor provided in a predetermined relation with respect to the transportation path and constantly rotating at a predetermined speed for electrophotographically forming a latent image corresponding to the image of the document original read by the image reading section on a surface thereof, developing the latent image into a toner image and carrying the toner image thereon;

transferring means disposed opposite to the surface of the drum-shaped photoreceptor with the transportation path interposed therebetween for transferring the toner image carried on the photoreceptor to the transfer sheet transported through the transportation path;

fixing means disposed downstream of the transferring means along the transfer sheet transportation direction on the transportation path for fixing the toner image on the transfer sheet while taking in the transfer sheet transported along the transportation path at a relatively high transportation speed and discharging the transfer sheet; and feeding speed control means for controlling the document-original feeding means so as to change the relative positional relation between the image reading section and the document original at a relatively low first speed until the leading edge of the transfer sheet transported through the transportation path reaches the fixing means and, in response to the leading edge of the transfer sheet reaching the fixing means, controlling the document-original feeding means so as to change the relative positional relation at a relatively high second speed.

2. An image forming apparatus as set forth in claim 1, wherein the first speed controlled by the feeding speed control means is equivalent to the circumferential speed of the drum-shaped photoreceptor, and the second speed varies depending on the type of transfer sheet.

3. An image forming apparatus of electrophotographic type for transferring an image on a transfer sheet having a length longer than a distance between an image transferring position and a fixing position, the image forming apparatus comprising:

an image reading section for reading an image of a document original along a reading line;

document original feeding means for changing a relative positional relation between the image reading section and the document original in a direction perpendicular to the reading line;

a transportation path for guiding the transfer sheet;

a drum-shaped photoreceptor provided in a predetermined relation with respect to the transportation path and constantly rotating at a predetermined circumferential speed for electrophotographically forming a latent image corresponding to the image of the document original read by the image reading section on a surface thereof, developing the latent image into a toner image and carrying the toner image thereon;

transferring means disposed opposite to the surface of the drum-shaped photoreceptor with the transportation path interposed therebetween for transferring the toner image carried on the photoreceptor to the transfer sheet transported through the transportation path;

fixing means disposed downstream of the transferring means along the transfer sheet transportation direction on the transportation path for fixing the toner image on the transfer sheet while taking in the transfer sheet transported along the transportation path at a higher transportation speed than the circumferential speed of the photoreceptor and discharging the transfer sheet; and feeding speed control means for controlling the document-original feeding means so as to change the relative positional relation between the image reading section and the document original at a relatively low first speed until the leading edge of the transfer sheet transported through the transportation path reaches the fixing means and, in response to the leading edge of the transfer sheet reaching the fixing means, controlling the document-original feeding means so as to change the relative positional relation at a relatively high second speed.

4. An image forming apparatus as set forth in claim 3, wherein the first speed controlled by the feeding speed control means is equivalent to the circumferential speed of the drum-shaped photoreceptor, and the second speed varies depending on the type of transfer sheet.

* * * * *